United States Patent [19]

Bourgeois

[11] Patent Number: 4,841,863

[45] Date of Patent: Jun. 27, 1989

[54] SABOTED, LIGHT ARMOUR PENETRATOR ROUND WITH IMPROVED POWDER MIX

[75] Inventor: Tom J. Bourgeois, Tallahassee, Fla.

[73] Assignee: Olin Corporation, Stamford, Conn.

[21] Appl. No.: 725,070

[22] Filed: Apr. 19, 1985

[51] Int. Cl.[4] ..... F42B 13/16

[52] U.S. Cl. ..... 102/523; 102/283; 264/3.1

[58] Field of Search ..... 102/430, 520–523, 102/283; 264/3 R, 3.1

[56] References Cited

U.S. PATENT DOCUMENTS

| | | | |
|---|---|---|---|
| 2,027,114 | 1/1936 | Olsen et al. | 52/22 |
| 3,679,782 | 7/1972 | Andrew et al. | 264/3 E |
| 4,015,527 | 4/1977 | Evans | 102/700 X |
| 4,123,975 | 11/1978 | Mohaupt | 102/518 |
| 4,126,955 | 11/1978 | Coffield, Jr. et al. | 102/520 X |
| 4,416,712 | 11/1983 | Monch et al. | 149/93 X |
| 4,478,150 | 10/1984 | Sayler et al. | 102/430 |
| 4,522,126 | 6/1985 | Bell | 102/529 X |

*Primary Examiner*—Peter A. Nelson

*Attorney, Agent, or Firm*—John R. Wahl

[57] ABSTRACT

This invention relates to a saboted, light armour penetrating small caliber ammunition round.

10 Claims, No Drawings

SABOTED, LIGHT ARMOUR PENETRATOR ROUND WITH IMPROVED POWDER MIX

BACKGROUND AND SUMMARY OF THE INVENTION

At the present time, there are basically three nongovernment manufacturers of propellant powders: Winchester Group of Olin Corporation, Hercules, and DuPont. Hercules and DuPont make extruded powders while Olin makes oblate spheroid powders. In addition to making powder, Olin (dba Winchester) and DuPont (dba Remington) are the world's leading commercial ammunition manufacturers. In addition, the U.S. Government has oblate spheroid powder operations and ammunition plants, and the U.S. Government probably has the most advanced ammunition research facilities in existence anywhere. Out of these government research facilities came a program to develop an improved 7.62mm cartridge capable of increased armour penetration. One proposal was to use a saboted, light armour penetrator at ultra high (greater than 4,000 feet per second) velocity with spin stabilization. However, these advanced government research facilities, having a design, were unable to make it work. Sabot breakup occured in the barrel and yet sabot changes such as a washerlike force multiplier in the sabot base did not solve the problem. Since the U.S. Army is currently carrying, as standard issue, 7.62mm rifles, it is of major importance to solve the problem and thus give the infantryman a better chance against lightly armoured targets. For this proposed 7.62 mm SLAP round the government specified WC680 powder, an oblate spheroidal powder made by Olin at St. Marks, Fla.

It is well recognized that:

Present 7.62 mm ammunition cannot penetrate light armour.

The service presently has 7.62 mm guns in action as standard issue.

Serious consideration to switching to 5.56 mm guns and 5.56 mm ammunition in view of equivalent penetration and long-range ability demonstrated by such 5.56 mm candidates at the SS109 made by FNH of Belgium and "Winchester" of U.S.A.

The service has an obvious preference to develop enhanced 7.62 mm ammunition that has the ability to penetrate light armour in order to avoid an expensive switch to lighter 5.56 mm ammunition with the resultant requirement of a switch over of virtually all existing combat guns. Also, the 7.62 mm is a bigger, heavier round and would thus be expected to out-distance enemy 5.56 mm rifles and to penetrate more armour or do more damage to a target given equal penetration.

In view of the need of America for successful solution of this problem, Winchester undertook independent effort to solve these problems which had baffled the foremost military ammunition experts.

The results at Winchester with the present invention were stunning. A particular experimental powder mix was found to solve both sabot breakup and low velocity, resulting in the first successful 7.62 mm light armor penetrating round; one which, on test, penetrates the armour (both sides) of simulated Russian armoured personnel carriers. The round thus gives the 7.62 mm rifles the heretofore absent ability to defeat current light armour plate and may well help prevent the service from having to switch over to 5.56 mm hardware. To put it graphically, it is believed that this round has enough penetrating ability to knock apart the treads of current Russian tanks by shots fired from current infantry carried guns. Furthermore, the 7.62 mm SLAP, with use of the invention, has superior penetrating ability to that of any currently available 5.56 mm round.

The invention is also suitable for scale-up into 0.50 caliber rounds with the probable ability to defeat medium armour plate using the widely available 0.50 caliber machine guns.

The inventon solves these problems by providing the round with a propellant charge of high loading density (volumetric) consisting essentially of spherical propellant particles. At least about 95% preferably have a grain diameter within the range of from about 0.082" to about 0.0232", and an average grain diameter within the range of from about 0.0145" up to about 0.0170".

DETAILED DESCRIPTION

The initial observation of military experts has been surprise that a powder change solved the problem as military experts had thought the problem was one of sabot design. The reason for applicant's successful solution was precision testing, which indicated the existence of a powder positioning problem combined with the knowledge of certain secret experimental powder mixes that only Olin (Winchester) had and which had been made to solve powder positioning problems in elephant gun proof testing ammunition such as proof load .458 Winchester magnum centerfire rifle cartridges. It is unlikely that anyone other than an Olin employee could have made the present invention because the powder mix was a special experimental powder developed for internal test purposes and possible use in proof loads (i.e. special high pressure cartridges used to test barrel strength), which are loaded to produce about 71,000 to 74,000 psi chamber pressure.

"Spherical" (spheroid) and "modified spherical" (oblate spheroid) globular powders are presently manufactured by either a batch process such as that disclosed in U.S. Pat. No. 2,027,114 or the continuous process of U.S. Pat. No. 3,679,782 (herein incorporated by reference as if set forth at length) with various modifications. There are over fifty different commerically available types of globular propellant powders, the difference primarily being in terms of web (thickness), grain size, amount of nitroglycerin (an energy booster) and deterrent (to slow burning), all to vary burning speed and pressure. The ammunition manufacturer selects a powder which produces the proper ballistics upon test firing. The ammunition maker may also look to other powder types such as extruded or flake if globular powder does not give proper ballistics.

For the 7.62 mm SLAP round, however, numerous commercially available extruded, flake, spherical and rolled spherical powders were tried in an attempt to find the magic mix, but without success. Either there was sabot breakup or excessive pressures (>50,000 psi) with powder-to-bullet or powder-to-primer or both, or insufficient (less than 4,000 feet per second) velocity. These commercial powders were tried because applicant perceived a "powder positioning" problem since high pressures were experimentally observed during test firing with powder against bullet but not with powder against primer, and applicant wanted to see if a powder change would solve the problem.

The powder of the invention upon test firing produced the desired velocity without excessive pressure.

This powder of the invention was a double-base spheroidal powder produced at St. Marks, Fla. by Olin Corporation. The powder had 11% by weight nitroglycerin, 2.5% to 2.8% by weight dibutylphthalate (deterrent), a gravimetric density of 9.50, an average grain diameter of 0.0155". This special powder had been experimentally developed as a possible solution to powder positioning problems in 0.458 Winchester magnum (elephant gun) proof loads. The powder is loaded at a relatively high volumetric loading density (at least 95%) in 7.62 mm. Loading density (LD) is defined as:

A 100% loading density would indicate that the available space for powder is 100% filled with powder under gravimetric flow condition. The fact is, however, that powder settles or "packs" to some degree upon agitation and may after substantial agitation occupy less than 100% even if loaded to 100% loading density. In testing, non-spherical powders may have failed because they settle enough to move away from the primer or perhaps because their ballistics are different when tightly packed than loosely packed. However, this does not explain why the commerically available spherical powders also failed. These phenomena are difficult to explain because the powder is ignited in a fraction of a second inside a cartridge which is inside a gun chamber and hence the powder ignition is not really observable under actual shooting conditions. In order to eliminate the powder positioning problem while still giving satisfactory ballistics, it is felt that the average grain diameter to the powder must be within the range of from about 0.0100" up to about 0.250 and preferably in the range of from about 0.0145" up to about 0.0170'.

What is claimed is:

1. In a plastic-saboted small caliber ammunition round, having a hard metal core subcaliber core adapted to penetrate light armor, the improvement which comprises a propellant charge of unrolled spheroidal powder having a specific energy density of at least 350,000 ft/lbs./lb. with an average grain diameter within the range of from about 0.0100" up to about 0.0250", said round having a volumetric propellant charge loading density of at least 95%.

2. The round of claim 1 wherein said powder is a surface-deterred, double-base powder.

3. The round of claim 2 wherein the powder nitrocellulose impregnated with nitroglycerine.

4. The round of claim 1 wherein said powder is produced by the continuous globular powder process.

5. The round of claim 1 wherein said average grain diameter is within the range of from about 0.145 inches up to about 0.170 inches.

6. The round of claim 1 wherein said powder has a chemical composition which comprises by weight percent:

7. The round of claim 1 wherein said round is a 7.62 mm ammunition round.

8. The round of claim 7 wherein said round has a metal subcaliber penetrator within said sabot.

9. The round of claim 7 wherein said powder charge has sufficient energy to propel said round at muzzle velocities in excess of 3,500 feet per second.

10. The round of claim 9 wherein said muzzle velocities exceed 4,000 feet per second.

* * * * *

UNITED STATES PATENT AND TRADEMARK OFFICE

CERTIFICATE OF CORRECTION

PATENT NO. : 4,841,863

DATED : June 27, 1989

INVENTOR(S) : Tom J. Bourgeois

It is certified that error appears in the above-identified patent and that said Letters Patent is hereby corrected as shown below:

IN THE ABSTRACT:

Please delete "This invention relates to a saboted, light armour penetrating small caliber ammunition round." and insert -- An improved propellant powder mix for a small caliber plastic saboted, light armour penetrator round is a charge of unrolled spheroidal powder having a specific energy density of at least 350,000 ft/lbs/lb with an average grain diameter from about .0100 inches to .0250 inches, and a volumetric propellant charge loading density of at least 95%. --

In column 3, line 11, after "as:" insert --

$$LD = \frac{\text{actual charge weight}}{\text{actual gravimetric density x case volume}}$$ --

In claim 6, column 4, line 22, after "percent:" insert --

| | |
|---|---|
| Nitrogen | 13.00 to 13.20 |
| Nitroglycerin | 8.50 to 11.50 |
| Dinitrotoluene | less than 1.01 |
| Deterrent | 1.25 to 4.25 |
| Diphenylamine | 0.75 to 1.50. -- |

Signed and Sealed this

Seventeenth Day of April, 1990

*Attest:*

HARRY F. MANBECK, JR.

*Attesting Officer*

*Commissioner of Patents and Trademarks*